US005789691A

United States Patent [19]

Stich

[11] Patent Number: 5,789,691

[45] Date of Patent: Aug. 4, 1998

[54] MULTI-FUNCTIONAL COIL SYSTEM FOR STRINGED INSTRUMENTS

[76] Inventor: Willi L. Stich, 314 Taylor St., Bethlehem, Pa. 18015

[21] Appl. No.: 701,253

[22] Filed: Aug. 20, 1996

Related U.S. Application Data

[63] Continuation-in-part of Ser. No. 373,621, Jan. 17, 1995, abandoned.

[51] Int. Cl.[6] ..... G10H 3/18

[52] U.S. Cl. ..... 84/726

[58] Field of Search ..... 84/726–728

[56] References Cited

U.S. PATENT DOCUMENTS 3,657,461 4/1972 Freeman ..... 84/726

3,902,394 9/1975 Stich ..... 84/728

*Primary Examiner*—Stanley J. Witkowski

*Attorney, Agent, or Firm*—Sanford J. Piltch

[57] ABSTRACT

A multi-function coil for use in a magnetic pickup apparatus for transducing the mechanical motion of the stings of an instrument wound on a single coilform structured to separate the single continuous coil into first and second collinear segments in each of two winding spaces, each coil having a predetermined number of turns and being uniformly spaced one from the other, for substantially eliminating distortion and harsh sounding overtones by the reduction of the mutual inductance of the first and second segments of the single continuous coil.

8 Claims, 2 Drawing Sheets

MULTI-FUNCTIONAL COIL SYSTEM FOR STRINGED INSTRUMENTS

This application is a continuation-in-part of application Ser. No. 08/373,621 filed Jan. 17, 1995 and now abandoned.

FIELD OF THE INVENTION

A multi-function coil system for use in a magnetic pickup for stringed musical instruments for reducing resonant peaks. This is accomplished by the use of a continuous coil on a single coilform being spaced apart in two separate winding spaces of the coilform. This structure allows the player of the instrument to gradually adjust the inductance and to reduce and shift the resonant peaks to desired levels and ranges resulting in a variety of different sound qualities.

BACKGROUND OF THE INVENTION

Coil systems have been utilized in magnetic pickups for stringed musical instruments, particularly electric guitars, for some time to generate electrical energy in response to changes in differing mechanical motion of the various strings of the musical instrument. The pickups, or tranducers, are generally of the magnetic type where the string vibration or mechanical motion causes the pickup to generate or induce electrical signals into a coil or inductor. These resulting signals are then amplified, with the audio output of the amplifier connected to a loudspeaker.

The sound characteristics of a magnetic pickup depend upon its inductance, its resonant peaks, the total frequency response, and its physical location on the instrument. All presently manufactured guitar amplifiers are made for high impedance input ranges. Thus all pickups for use with the amplifiers have an impedance between 10K ohms and 60K ohms at a frequency of 1 KHz.

Pickups with an impedance below 10K ohms reproduce excellent high frequencies, but fewer low frequencies. These lower impedance pickups perform relatively well in the neck position, but in the vicinity of the bridge, the high frequencies correspond with the harmonics of the strings which are concentrated at the bridge resulting in a "tinny" sound. On the other hand, pickups with an impedance above 25K ohms have poor high frequency response, but an excellent bass or low frequency response. The result is that currently available pickups are sensitive to both coil impedance and to physical position, but with not one able to be positioned in a single location and have a full range frequency response.

Another disadvantage of the high impedance pickups are the wide band resonant peaks in the mid-frequency range. It is these wide band resonant peaks that cause the resulting amplified sound to be undesirable to the listener, and to the player. Until now it has been customary to either adjust the pickups using external circuitry or to utilize a plurality of pickups and switch among them. The present invention seeks to overcome the stated disadvantages by utilizing a unique construction of a continuous coil winding in a pick-up.

One construction of a pickup using a single coilform, but with separate windings spacings, is described in U.S. Pat. No. 2,119,534 [Knoblaugh]. This pickup utilizes one winding as an electromagnet (reliable permanent magnets not being available at the time) to effect the response of the single winding for "hum" cancellation. Thus, coilforms having two separate winding spaces were previously used, but solely for "hum" cancelling purposes.

All such pickups were spaced apart from the strings of the instrument. Single spaced pickups have been known and used for many years. These pickups can be tapped at various locations so that by switching tap points the impedance of the resulting electrical signal changes from low to medium impedance, and then to high impedance. This external circuit control permits a variety of different sounds to be achieved.

As stated previously, all guitar amplifiers used with magnetic pickups are currently of the high impedance type. The high impedance causes severe problems in generating sound in the higher frequency spectrum. This frequency restriction, combined with a greater loss of highs caused by capacitance from the cable connecting the guitar to the amplifier, compounds the problem of accurately producing a balanced sound across the entire frequency spectrum.

Combinations of pickups that are not adjacent and share no mutual inductance are common practice. These systems transduce the string vibrations at different segments of the strings, and therefore suffer phase cancellations. In some cases this phase cancellation generates some interesting sound colorations. But, only a single coil pickup can generate an overall balanced sound.

Pickups having an impedance of 20K ohms reproduce a good low end sound, but the high end sounds are suppressed. With increasing impedance strong resonant peaks are shifted to the higher mid-range (corresponding with the 6th through the 16th harmonic of the strings) which results in a harsh, rough, edgy, undesirable sound. On the other hand, pickups with an impedance below 10K ohms can reproduce excellent highs, but the low end sounds are weak, fairly insignificant, and insufficient to be accurately reproduced by the associated amplifier.

It has been found over a period of many years that a coil wound in a single spacing develops strong resonant peaks causing undesirable harsh overtones. The practicality of wiring one tap point to a variable resistor to attempt to bypass or shunt the "highs" from one section of the coil to another is unavailing because the first section of the coil will gradually approach zero impedance through the resistor resulting in an enormously devastating dissipation effect on the other section(s) of the coil. Hence, earlier pickups have, not been able to operate across the full signal spectrum due to this dissipation factor.

As a further problem facing a designer for a pickup capable of full spectrum response without harsh overtones in the reproduced sound, amplifiers are each different in both type and input sensitivity. Some amplifiers still utilize vacuum tube circuitry and others solid state devices to produce the amplified sound. With the present magnetic pickups (single coils, paired coils, etc.) impedance output of the pickup must be varied to accommodate different amplifier input sensitivities to perform equally well with all of the different kind of amplifiers.

Also, playing styles vary from an ultra-clean response to a heavily distorted sound overdriving the amplifier and must be taken into consideration. Thus, for each amplifier and each guitar connected to the amplifier, as well as the player's style of play and the ultimate sound desired to be achieved, a different pickup with varying electromagnetic response (as demonstrated by non-continuous impedance ranges) is required to produce the desired full spectrum of sounds.

In pick-ups having at least two winding spaces, or tapped windings which electrically cause a separation of a single winding into a plurality of windings, it has been determined that the mutual inductance of the "coils" is a significant factor in the accurate reproduction of sounds caused by the excitation of the "coils" in response to the frequency of the instrument's vibrating string. Further, with mutual inductance, the existence of eddy currents (or counter-emf) between coil segments or the core and the coil greatly affects the behavior (sound reproduction quality) of magnetic pick-ups. Several physical attributes of the magnetic or induction type pick-up have been determined to cause significant changes in the accuracy of the sound reproduction across the frequency spectrum, and from low to high impedance, which directly depends upon the physical spacing of the "coils" from the excitation source (the strings of the instrument), and the particular construction of the magnetic pickup. Currently magnetic pick-ups for stringed instruments are not constructed to account for the behavior of eddy currents in the coils, which produces a counter-emf to the induced current within the coil significantly affecting the characteristics of the reproduced sound as discussed above.

The goal of the pickup designer, with regard to the present invention, is to create an inexpensive magnetic pickup to overcome these existing problems and design such magnetic pickup to be perfectly matched to any amplifier, as well as being under- or over-matched to obtain both ultra-clean and overdriven distorted sounds. This is to be accomplished without the use of expensive preamplifiers or other electronic filtering devices. Thus, it is an object of the present invention to design a magnetic pickup which can achieve variable impedance matching.

It is a further object of the present invention to reduce and shift the resonant peaks of the reproduced sound so that the pickup will perform equally well across the entire signal spectrum.

It is also an object of the present invention to accomplish the foregoing on a single coilform having predetermined winding spacings and spacing dimensions.

It is an additional object of the present invention to construct a single coilform as a magnetic pick-up apparatus for a stringed musical instrument which maximizes the accuracy of the sound reproduction depending directly upon the physical attributes and construction of the pick-up.

Other objects will appear hereinafter.

SUMMARY OF THE INVENTION

A magnetic pickup for transducing the mechanical motion of the strings of an instrument into electrical signals for output to an audio amplifier is positioned proximally to and transversely underlying the strings having a single coilform housed therein. This coilform separates the single continuous coil into an upper and a lower segment in each of two winding spaces, each coil segment being collinear with the other and having the same or a different number of turns for acting upon the mutual inductance of the coil.

A plurality of neutral pole pieces are placed within the coilform so that, as current flows in the coil segments, not only a mutual inductance occurs, but also a counter-emf or eddy current is created between the coil segments. The strength of both the mutual inductance and the eddy current depend directly upon the mass, conductivity and proximity of the pole pieces to the coil, the spacing between the coil segments, as well as the separation between the coil and the strings of the instrument, and the electrical characteristics, especially resistance, of the coil segments.

The magnetic pick-up acts as a variable frequency generator as the strings are shortened or lengthened by playing causing the induced magnetic response to the vibration of each string to affect the response in conjunction with the overall resistance of the coil and any attached control circuit. In this manner, the magnetic pick-up is able to control the mutual inductance of the two coil segments and to cause the frequency shift of the resonant peaks to eliminate transmission of harsh sounding overtones and produce ultra-clear reproduced sound.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE INVENTION

The following detailed description is of the best presently contemplated modes of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
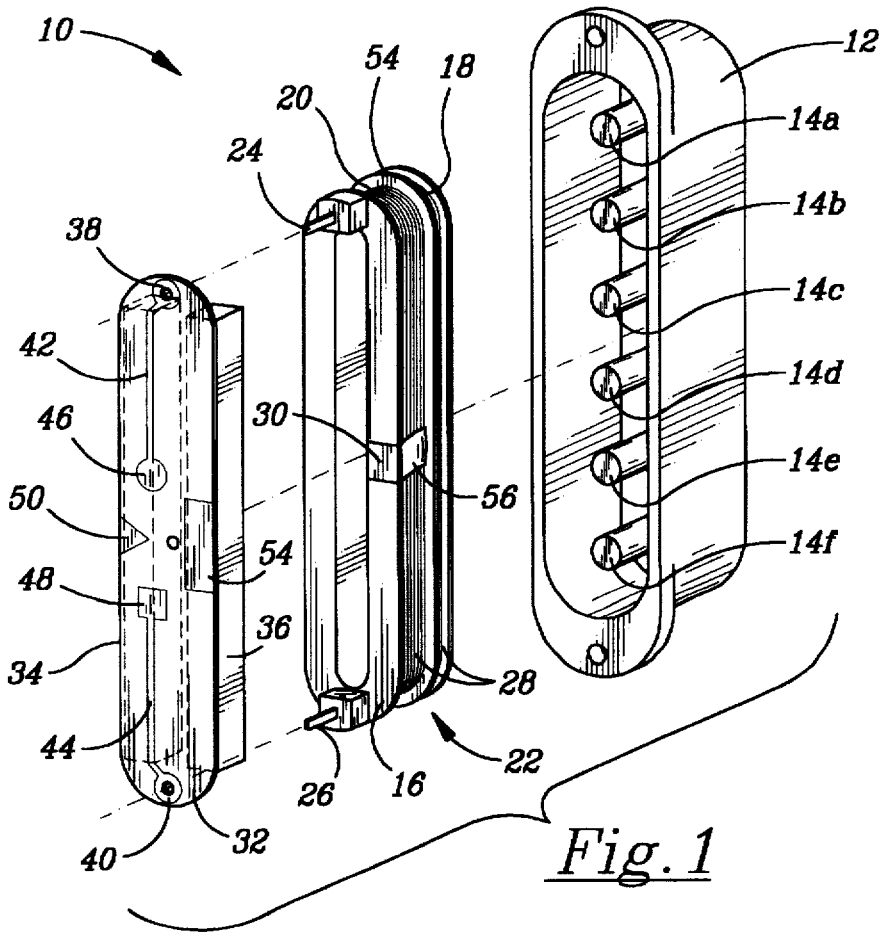
FIG. 1 is an exploded view of the magnetic pickup apparatus of the present invention.

The drawings used herein illustrate the details of the present invention and use like numerals to indicate like elements. With reference to FIG. 1, there is shown the magnetic pickup 10 of the present invention. The exploded view of FIG. 1 enables the viewing of the internal parts housed within the pickup shell 12. Each of the pins (or pole pieces) **14*a*–14*f* are spaced apart from the surrounding wire coil a distance ranging between 0.015" and 0.050". However, by experimentation, it has been determined that a preferred distance is 0.030". Further, each of the pins 14*a*–14*f* are electrically neutral from each other and from the coil. Within the shell 12 are a series of in-line ferromagnetic poles or pins 14*a*–14*f* arranged along the longitudinal axis of the shell 12 so as to extend through, and with each pin end flush to, the body of the shell 12. In this way the pins 14*a*–14*f*** are able to react to the transverse motion or vibration of each string under which the pins are located (when mounted on a guitar, for example) by inducing a magnetic inductance which changes according to the string motion.

The pins **14*a*–14*f* are surrounded by a single coilform 16 which has a central elongated hollow to accommodate the pins 14*a*–14*f* passing therethrough. The coilform 16 has two separate winding spaces 18, 20 for accommodating very thin copper wires which form the coil 22. As the mass of the copper wires forming coil 22 is critically dependent in managing the mutual inductance and counter-emf, it has been determined that the wire gauge be 44 AWG, or a finer wire gauge. The upper winding space 18 and the lower winding space 20 can be seen more readily with reference to FIG. 2 which shows the coilform 16 without any wire in the winding spaces. The particular dimensions and spatial relationships of the winding spaces 18, 20** will be more specifically described hereinafter.

Located on the upper face of the coilform 16 are two pins 24, 26, each located at an opposite end of the elongated oval coilform 16. These pins 24, 26 provide a connection point for the ends of the wire 28 used to create the coil 22. Also located on the upper face of the coilform 16 is a tap point 30 to which the wire 28 is attached as the wire traverses the coilform 16 between the winding spaces 18, 20.

Placed over the coilform 16, once the coil 22 is created and the coilform 16 is placed within the shell 12, is a cap piece 32 having two permanent magnets 34, 36 mounted to its underside along each of the elongated sides. In the described embodiment the magnets 34, 36 are preferred to be of an elongated bar shape, but can be of any shape as long as the magnets 34, 36 contact the pins 14*a*–14*f* magnetizing them. In this way the magnets 34, 36 are mounted on either side of the array of metal pins 14*a*–14*f* and overlie the long sides of the coil 22 created on the coilform 16 when the cap piece is placed within the shell 12.

Thus, the magnets 34, 36 are positioned to effectively magnetize the metal pins 14*a*–14*f* and to react to any induced magnetic fields caused by the mechanical motion of the musical instrument strings transversely overlying the pickup 10. The changes in the induced magnetic fields will directly affect the magnetic circuit established between and among the metal pins 14*a*–14*f*, the coil 22, and the magnets 34, 36.

The cap piece 32 also provides a location for electrical connection to the coil 22 and to external controls and sound amplifying systems. Directly overlying each of the connecting pins 24, 26 are cooperating holes 38, 40 through which the pins 24, 26 are inserted and electrically connected by soldering with a conductive metal solder. The connection pins 24, 26, and thus the coil 22, are connected through electrically conductive metal paths 42, 44 to external connection pads 46 (round) and 48 (square). The specific wiring connections to these pads 46, 48 will be more specifically described hereinafter. Also positioned on the cap piece 32 are connection pads 50 (triangular) and 52 (rectangular). The pads 50, 52 overlie each of the magnets 34, 36 and are used as connections to the external connecting wire shield which is, in turn, connected to an electrical ground.

Figure 5:
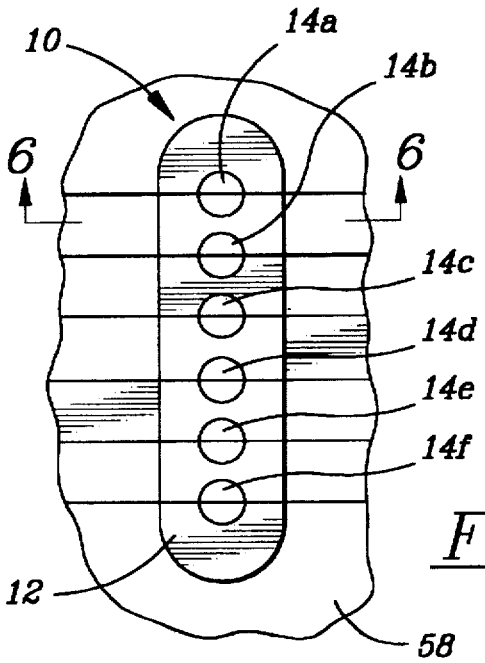
FIG. 5 is downward looking overhead view of the strings of the musical instrument showing the placement and alignment of the magnetic pickup of the present invention in relation to the strings of the musical instrument.

The pickup 10 may be placed in several locations on, for example, a guitar 58. See, for example, FIG. 5. Placement of the pickup 10 may be made at the neck, at the bridge, or in the sound hole. It is required that the exposed end of the metal pins 14*a*–14*f* be in close proximity to and aligned with the strings of the instrument so that the mechanical motion of each metal string can have an effect on the inductance of the various elements housed within the pickup 10. In order to assure the proximity of the coil 22 to the strings, the shell 12 of the coilform 16 is dimensioned to a minimum depth of approximately 1/16th of an inch, which is still sufficient to adequately support the coil 22 and within the dimensional spacing requirements discussed below to permit the vibrating string to affect the mutual inductance of the entire coil.

The pickup 10 may be connected either directly to an amplifier or to a switch interposed between the amplifier and the pickup 10 utilizing the connection pads 46, 48, 50 and 52 located on the cap piece 32. The round pad 46 is the signal output for the pickup 10 and can be connected either to a volume control (not shown) and usually mounted into the guitar or to a pickup selector switch (not shown) for guitars with more than one pickup. For use as a pickup, the second signal wire, of the two wire and shield cable from the pickup 10, which is connected to the square pad 48, and the shield, which is connected to both the triangular pad 50 and bridged to the rectangular pad 52, are connected to the housing (ground) of the volume control or selector switch. In this manner the pickup 10 affords the user an extended range pickup over a much broader impedance range without harmonic overclipping and a dramatic reduction in the decay effect. The pickup 10 achieves this result as described below with reference to all Figures.

Figure 2:
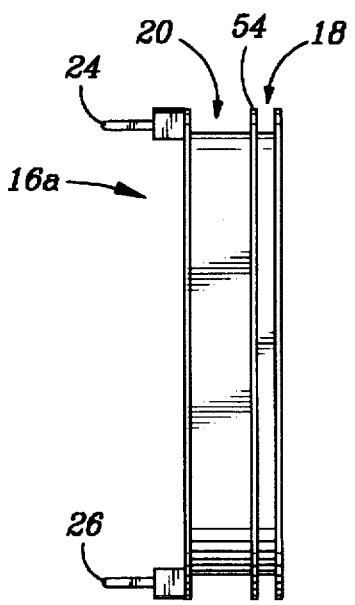
FIG. 2 is a side view of a first coil arrangement for the magnetic pickup apparatus of the present invention.
Figure 6:
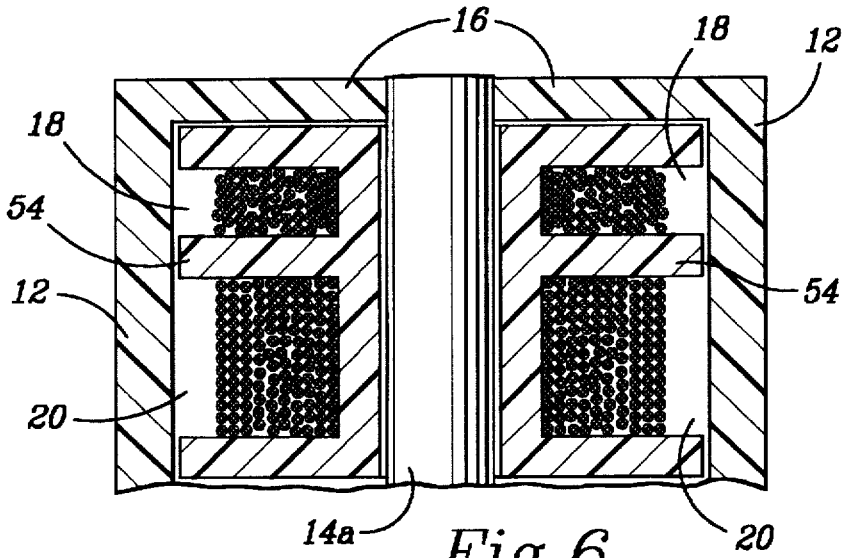
FIG. 6 is a sectional view of the third coil arrangement for the magnetic pickup apparatus of the present invention taken along Line 6—6 of FIG. 5.

The single coilform 16 is dimensioned to form two separate winding spaces 18, 20 for the coil 22. These separate winding spaces 18, 20 are spaced apart vertically by a separator 54. With reference to FIGS. 1, 2 and 6, the winding spaces 18, 20 are shown with the upper winding space 18 being dimensioned smaller than the lower winding space 20.

With the coilform 16 a dimensioned in the manner just described, the wire 28 is attached to the connecting pin 24 by soldering and may then wound about the coilform 16*a* in the lower winding space 20. When the desired number of turns is achieved, the wire 28 is attached by soldering to the tap point 30 through the depending conductor strip 56. Then the wire 28 is continued to be wound in the coilform 16*a* (without break or termination) in the upper winding space 18. When the desired number of turns is achieved, the wire 28 is attached to connecting pin 26 by soldering thereto. In this manner the upper winding space 18 contains, de facto, fewer turns of the the wire 28 than are contained within the lower winding space 20. Alternately, the number of turns may be equal, as in coilform 16*b* of FIG. 3, or have more turns in the upper winding space 18 than in the lower winding space 20, as in the coilform 16*c* of FIG. 4. The particular construction of the coilform 16 is directly dependent upon its position on the guitar.

An extremely important consideration in achieving the desired operating range of the pickup 10, is the dimension of the wall 54 separating the winding spaces 18, 20. The separation between the lower winding space 20 and the upper winding space 18 must be greater than 0.030 inches but less than 0.080 inches. Optimally the depth of the wall 54 is suggested to be 0.040 inches. The separation between the winding spaces 18, 20 and the coil segments contained therein causes an increase of mutual inductance in the magnetic field of the coil 22 and an increase in the respective eddy currents. The eddy current emanates from the coil segment more distant from the string affecting the mutual inductance of the entire coil. It has been experimentally determined that the appropriate spacing between the lower coil segment (the most significant source of eddy currents) and the string is required to maintain the highest possible mutual inductance. The high value of mutual inductance results in a dramatic reduction in the dissipation or decay effect (described above) of the output electrical signal. The overall distance or spacing between the string and the farthest reaches of the lower winding space 18 must fall within the range of 0.5" and 1.0". However, through experimentation, it has been determined that the preferred spacing lies in the range of 0.6" to 0.8".

Further, the particular structure of the single continuous coil 22 is well suited to correcting the harshness of the reproduced sound of present pickups. When a section of the coil, the segment of the coil 22 contained in the lower winding space, has one end removed from electrical ground and connected to an appropriate capacitor with the other end of the capacitor connected to the tap point 30 (the other end of the lower coil segment) such arrangement significantly reduces and frequency shifts the resonant peaks as if there existed a cross-over relationship between the coil segments. It is to be understood that the tap point 30 is not the only location where the coil 22 can be tapped. Any location within the segment of the continuous coil 22 within the lower winding space 20 may be tapped with similar results varying only the extent of frequency shifting of the resonant peaks.

Taken together, the physical structure of the coilform 16 with the separator wall 54 between the two winding spaces 18, 20, the appropriate physical separation within the stated dimensional range of the spacing between the distal periphery of the lower segment of the coil and the various strings of the instrument, and the appropriate tapping of the continuously wound coil 22 cause the pickup 10 to more accurately and clearly reproduce the sounds to the demand of the player.

Figure 3:
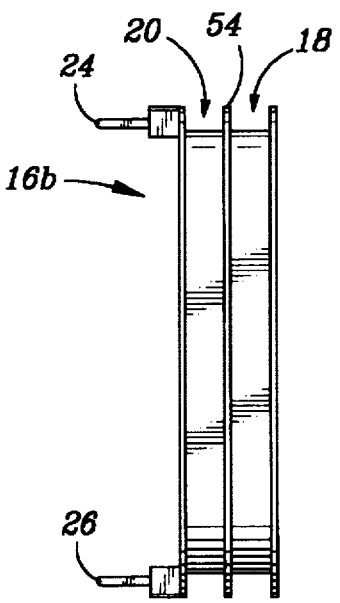
FIG. 3 is a side view of a second coil arrangement for the magnetic pickup apparatus of the present invention.

Although the preferred dimensions for the winding spaces 18, 20 is described above in connection with FIGS. 1 and 2, similar, if not identical results can be achieved with the coilform **16*b* shown in FIG. 3. Coilform 16*b* shows lower and upper winding spaces 18, 20 having identical dimensions. The separator wall 54 retains the same dimension as was previously described. It is important to the present invention that the lower winding space 20**, and the coil segment contained therein, remain within a certain fixed spatial dimension to the strings of the instrument in order that the mechanical motion of the strings causes the appropriate reaction to the inductance of the pickup.

Figure 4:
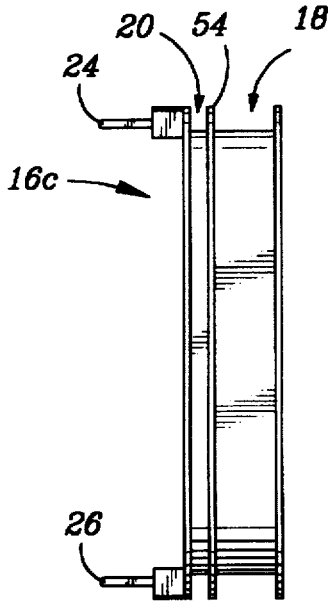
FIG. 4 is a side view of a third coil arrangement for the magnetic pickup apparatus of the present invention.

Coilform **16*c* in FIG. 4 shows the lower winding space 20 having a smaller height dimension than the upper winding space 18 with the wall 54 retaining the same dimension. Although such dimensioning of the winding spaces 18, 20 is not preferred, a suitable response can be obtained by winding the continuous coil wire the appropriate number of turns in each winding space. The wire 28 can be wound in the winding spaces 18, 20 of coilforms 16*b*, 16*c*** as was described above with the same connections being made to external wiring points.

A continuous coil, such as coil 22 separated into two winding spaces, having a predetermined aggregate number of turns has fewer resonant peaks than the same number of turns contained in a single winding space. On a coilform with only a single winding space, one can not bypass or shunt a greater number of turns of the coil as in the segmented coil in two winding spaces of the present invention because the bypassed of or shunted section would act as a closed loop on the remaining section of the coil resulting in the total loss of high end sound in the coil.

Figure 7:
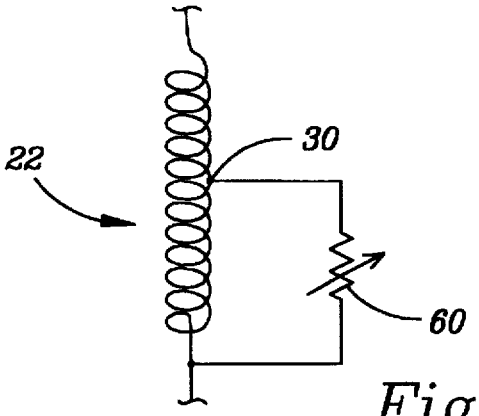
FIG. 7 is a simplified diagram of a circuit utilized in controlling the shifting and reduction of the resonant peaks in the present invention.

On a coilform with two winding spaces, like coilform 16, one can not bypass or shunt any section of the segment of the coil 22 in the upper winding space 18, which is closer to the strings, without losing the high end sound from that coil segment. But, however, one can bypass or shunt one or more sections of the segment of the coil contained in the lower winding space 20, or even the entire segment of the coil contained in the lower winding space, and not lose, but increase, the harmonic spectrum of the reproduced sound by several octaves. A representative shunt circuit using a variable resistor 60 between the tap point 30 and the end of the segment of the coil contained in the lower winding space is depicted in FIG. 7. The appropriate adjustment of the variable resistor produces the broader spectrum of sound discussed above.

Referring again to the preferred embodiment of FIG. 1, the reduction of the mutual inductance between the two segments of the coil 22 in each of the winding spaces 18, 20 is partially achieved through the appropriate dimensioning and spacing of the two segments of the coil 22 as well as each winding space 18, 20 containing the appropriate number of windings. The first segment of the coil 22 contained in the upper winding space 18 has, for example, 4000 turns and a measured inductance of 1.5 henrys. These values for the first segment will be utilized as the reference values for calculating the mutual inductance of the coil 22. The second segment of the coil 22 contained in the lower winding space 20 has 6000 turns. The mutual inductance of the coil 22 with an impedance of 1K ohms is calculated as follows:

$$Lm = \frac{\text{No. of Turns of Test Coil}^2}{\text{No. of Turns of } Ref. \text{ Coil}} \times Lref$$

$$L_m = (10{,}000/4000)^2 \times 1.5 \text{ henrys}$$

$$L_m = (2.5)^2 \times 1.5 \text{ henrys}$$

$$L_m = 6.25 \times 1.5 \text{ henrys}$$

$$L_m = 9.375 \text{ henrys}$$

The resulting calculated inductance, 9.0 henrys, is reduced by twenty (20%) percent due to the decrease in mutual inductance within the pickup 10 resulting in a calculated inductance of 7.5 henrys. The measured inductance of the first coil segment, 1.5 henrys, is reduced by twenty (20%) percent due to the dissipation effect resulting in a calculated inductance of 1.2 henrys. The ratio of the resulting calculated inductances 1.2:7.5 henrys is equivalent to the ratio 1:6.25. In order for these calculations to remain within their range of accuracy and to retain the expected calculated ratio, the dissipation effect must remain within the range from ten (10%) percent to twenty (20%) percent.

Further, and believed to be of greater significance, is both the sizing of the upper and lower coil segments and the physical placement (separation distance) of the pick-up 10 from the strings of the musical instrument. While it is mandatory for the pins **14*a*–14*f* to he spaced within a separation distance range from the strings to have the vibration of one or more strings collectively affect the magnetic circuit of the pick-up 10, it is not believed to have been previously known that the mass size of the coil, the conductivity of the coil (both electrical and magnetic), and the effect of the counter-emf or eddy current (as it effects the total magnetic inductance) directly affects the reproduction of sound from the pick-up 10 which is configured in accordance with this invention as a multi-frequency generator. Thus, it is important to note that in order to increase the mutual inductance of the coil 22 of the pick-up 10** the effect of the counter-emf (or eddy current) on that inductance must be decreased. This can best be done as follows.

It has been determined that the counter-emf (or eddy current) depends directly upon the total mass of the wire of the coil and the proximity of the wire of the coil to electrically neutral pole pieces (the pins **14*a*–14*f*) and to the frequency generators, the strings of the musical instrument. The mass of the wire which depends directly upon the wire gauge and the number of turns in the coil, or coil segment, directly affects both mutual inductance and any counter-emf occurring once the coil 22 of the pick-up 10 is excited by an external string vibration affecting the magnetic field surrounding the pick-up. Further, electrical resistance measured in the coil 22, or coil segment, also has been determined to affect the mutual inductance and counter-emf (eddy currents) which directly affect the overall electromagnetic field of the pick-up 10**.

As was discovered (and stated above), in order to maximize the mutual inductance, the counter-flowing eddy currents must be reduced. One method to reduce the eddy current is to reduce the number of turns in a coil segment, thus reducing the mass of that coil segment, which directly affects eddy currents in the other coil segment. As shown in FIGS. 2, 3 and 4, differently sized winding spaces can be utilized to control eddy currents by limiting the overall mass of the wire in the coil segment within the designated winding space. Another method is to reduce the number of turns within the designated winding space, not filling the winding space completely. The varying of the mass size of one coil segment can markedly reduce the inductance through that portions of the coil. Also, varying the mass size can affect the strength of the counter-emf or eddy current within the coil 22.

In further explanation, the magnetic inductance caused within an electrically energized coil creates a directional emf which is susceptible to measurement of magnetic inductance, which inductance is a portion of the mutual inductance of the coil 22. Likewise, within the electrically excited coil 22 of the pick-up 10, a counter-emf, an eddy current directionally opposing the emf generated by the vibration of the string, magnetically opposes the strength of the principal magnetic field, and the total mutual inductance of the coil 22 is significantly effected. With increasing eddy currents, because of their directional opposition to the magnetic current (or emf), the resulting reproduced sound first looses some of the resonant peaks, then some of the peaks in certain frequency ranges, and finally the sound becomes totally muddled.

The present invention may be described as two (2) coils (or coil segments) which are in phase with each other, are collinear and placed one atop the other, uniformly spaced apart, such that the mutual inductance of the coils (or coil segments) are additive and the eddy currents are, likewise, additive; all of which become part of the total mutual inductance. Further, construction of the present invention using similarly sized coil segments will produce eddy currents which will, in turn, dramatically increase the total resistance of the coil 22. The eddy currents can cause up to approximately a sixty (60%) percent loss in frequency and signal resulting in the distortion of the reproduced sound.

The eddy currents within the coil 22 can be controlled by placing a variable resistor across the lower coil segment as shown in FIG. 7. This variable resistor should be capable of varying over the range from 0 ohms up to 100K ohms. Alternatively, a resistor having a fixed value in the range between 5K ohms and 100K ohms can be used. The reduction of the eddy currents, by increasing the resistance using the variable or fixed resistor across the lower coil segment, will permit effective control over the upper coil segment to allow the accurate sounding of the resonant peaks across the entire frequency spectrum, thus reducing dissonance and the harshness of tone in the reproduced sound.

Hence, it has been learned that a "tap" containing a variable or fixed resistor across the lower coil segment will result in the reducing of the counter-emf (or eddy currents) in the overall coil 22, and causing little or no interference with the plurality of frequencies generated by the string and magnified through the magnetic pick-up 10. On the other hand, a "tap" within a coil segment will cause dramatically increasing counter-emf in the remaining portion of the coil (or coil segment), as well as causing interference with the frequencies generated by the string and magnified by the magnetic pick-up 10. Thus, an enhancement of the physical construction and placement of the magnetic pick-up 10 of the present invention is to add a control circuit by placing a variable resistance within the stated resistance range across the lower coil segment to reduce the counter-emf (eddy current or counter-magnetic inductance) in the overall coil and to significantly reduce any frequency interference with the vibration of the string as magnified in the inductor circuit of the pick-up 10.

With specific reference to FIGS. 2, 3, 4 and 6, it is imperative that the distal periphery of the lower coil segment fall within the stated dimensional spacing from the strings of the musical instrument. The particular winding space dimensions of different sizes in FIGS. 2, 3 and 4 are shown only to indicate that several different physical constructions of the winding spaces falls within the scope of the present invention in view of the restrictions on mass size (number of wire turns) of the upper coil segment versus the lower coil segment. FIG. 6 shows a smaller mass size (and number of turns) of the upper coil segment in the upper winding space 18 as against the increased mass size (and number of turns) of the lower coil segment in lower winding space 20. It should again be noted that the mass size can be varied by restricting the number of turns, even though the winding space dimensions can accommodate a greater number of turns, so that the mass size of the coil segment is utilized to control the counter-emf (eddy currents) so that the mutual inductance is maximized in accordance with the present invention.

Hence, a magnetic pickup having only a single coilform housed therein, which coilform is configured to segment the continuous coil wound thereon into two segments in separated collinear winding spaces and dimensioned to assure the closest proximity to the metal strings of the instrument, is able to achieve the specific reduction and frequency shift of the resonant peaks and control the dissipation effect to provide a broader range of ultra-clear reproduced sound without the harshness of overtones by controlling the eddy currents from the coil 22 of the pick-up 10 to maximize the mutual inductance.

Therefore, it should now be apparent that the total coil 22 of the present magnetic pickup apparatus 10 reproduces the low frequencies while the upper segment of the coil alone reproduces the high frequencies. The amount of highs and lows can be controlled by constructing a pick-up having the physical dimensional ranges of the present invention, placing the pick-up within the maximum separation distance from the strings of the musical instrument, proportioning the mass size of the coil segments by properly dimensioning the winding spaces or by restricting the number of turns within the coil segment, and by adjusting the total resistance of the lower coil segment with either a fixed or variable resistor as shown in FIG. 7.

The present invention may be embodied in other specific forms without departing from the spirit or essential attributes thereof and, accordingly, the described embodiments are to be considered in all respects as being illustrative and not restrictive, with the appended claims, rather that the foregoing detailed description, indicating the scope of the invention as well as all modifications which may fall within a range of equivalency which are also intended to be embraced therein.

I claim:

1. A magnetic pickup for transducing the mechanical motion of the strings of an instrument into electrical signals for output to an audio amplifier, said pickup positioned proximally to and transversely underlying the strings and having a single coilform housed therein, said coilform structured to separate the single continuous coil of the pickup into first and second segments in each of two winding spaces, said first and second coil segments being collinear with and uniformly spaced apart a predetermined distance from the other and having a predetermined number of turns dependent upon the vertical dimension of each winding space and the proportional mass of each coil segment to the other, said first coil segment being located no more than a predetermined distance from the strings of the instrument and having a resistance across said first coil segment within a predetermined range to control counter-magnetic inductance between said coil segments, whereby the counter-magnetic inductance of the first and second coil segments of the single continuous coil is reduced and the mutual inductance of the single continuous coil is maximized resulting in the frequency shifting of resonant peaks and reducing the dissipation effect of the output signal to eliminate distortion and transmission of harsh sounding overtones and produce ultra-clear reproduced sound.

2. The magnetic pickup of claim 1 wherein the reduction in the counter-magnetic inductance of the single continuous coil being achieved by restricting said predetermined spacing between the separate segments of the coil to within a range between 0.03 and 0.08 inches, restricting said predetermined distance between the strings of the instrument and the lower coil segment to within a range of 0.50 and 1.00 inches, and varying said resistance across said first coil segment within a range of 0 ohms to 100K ohms.

3. The magnetic pickup of claim 1 wherein the frequency shifting of resonant peaks and control of the counter-magnetic inductance being achieved by shunting the first coil segment of the single continuous coil with a variable resistor connected between the endpoint of said first coil segment and the tap point between the two coil segments of the single continuous coil, said resistor being adjustable over a range between 0 ohms and 100K ohms.

4. The magnetic pickup of claim 1 wherein the frequency shifting of resonant peaks and control of the counter-magnetic inductance being achieved by shunting the first coil segment of the single continuous coil with a variable resistor connected between the endpoint of said first coil segment and any point in the second coil segment of the single continuous coil, said resistor being adjustable over a range between 0 ohms and 100K ohms.

5. A single continuous coil for use in transducing the mechanical motion of a stringed musical instrument into electrical signals for output to an audio amplifier wound on a coilform, said coilform structured to separate the single continuous coil into first and second segments in each of two winding spaces, said first and second coil segments being collinear with and uniformly spaced apart a predetermined distance from the other and having a predetermined number of turns dependent upon the vertical dimension of each winding space and the proportional mass of each coil segment to the other, said first coil segment having a resistance across the coil segment within a predetermined range to control counter-magnetic inductance, whereby the counter-magnetic inductance of the first and second coil segments of the single continuous coil is reduced and the mutual inductance of the single continuous coil is maximized resulting in the frequency shifting of resonant peaks and reducing the dissipation effect of the output signal to eliminate distortion and transmission of harsh sounding overtones and produce ultra-clear reproduced sound.

6. The single continuous coil of claim 5 wherein the reduction in the counter-magnetic inductance of said continuous coil being achieved by restricting said predetermined spacing between the separate segments of the coil to within a range between 0.03 and 0.08 inches and varying said resistance across said first coil segment within a range of 0 ohms to 100K ohms.

7. The single continuous coil of claim 5 wherein the frequency shifting of resonant peaks and control of the counter-magnetic inductance being achieved by shunting the first coil segment of said continuous coil with a variable resistor connected between the endpoint of said first coil segment and the tap point between the two coil segments of the single continuous coil, said resistor being adjustable over a range between 0 ohms and 100K ohms.

8. The single continuous coil of claim 5 wherein the frequency shifting of resonant peaks and control of the counter-magnetic inductance being achieved by shunting the first coil segment of said continuous coil with a variable resistor connected between the endpoint of said first coil segment and any point in the second coil segment of the single continuous coil, said resistor being adjustable over a range between 0 ohms and 100K ohms.

* * * * *